US009212843B2

(12) United States Patent
Boarman

(10) Patent No.: US 9,212,843 B2
(45) Date of Patent: Dec. 15, 2015

(54) CUSTOM BIN INTERFACE

(71) Applicant: Whirlpool Corporation, Benton Harbor, MI (US)

(72) Inventor: Patrick J. Boarman, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 379 days.

(21) Appl. No.: 13/691,898

(22) Filed: Dec. 3, 2012

(65) Prior Publication Data

US 2014/0150472 A1 Jun. 5, 2014

(51) Int. Cl.

| | |
|---|---|
| ***F25D 11/02*** | (2006.01) |
| ***F25B 21/02*** | (2006.01) |
| ***F25D 25/00*** | (2006.01) |
| ***F25C 1/00*** | (2006.01) |

(52) U.S. Cl.

CPC ..... *F25D 11/02* (2013.01); *F25B 21/02* (2013.01); *F25C 1/00* (2013.01); *F25D 25/00* (2013.01)

(58) Field of Classification Search

CPC ..... F25D 11/02; F25D 25/00; F25D 21/02; F25C 1/00

USPC ..... 62/3.6

See application file for complete search history.

(56) References Cited

U.S. PATENT DOCUMENTS

| | | | | |
|---|---|---|---|---|
| 3,237,415 | A * | 3/1966 | Newton | 62/3.6 |
| 3,449,919 | A * | 6/1969 | Fox | 62/71 |
| 4,798,061 | A * | 1/1989 | LaConte | 62/348 |
| 6,148,624 | A * | 11/2000 | Bishop et al. | 62/137 |
| 6,293,107 | B1 * | 9/2001 | Kitagawa et al. | 62/3.6 |
| 6,412,286 | B1 | 7/2002 | Park et al. | |
| 6,735,959 | B1 | 5/2004 | Najewicz | |
| 6,908,163 | B1 * | 6/2005 | Hebeler et al. | 312/405.1 |
| 7,216,490 | B2 | 5/2007 | Joshi | |
| 7,472,974 | B2 * | 1/2009 | Czach et al. | 312/405.1 |
| 2004/0012314 | A1 * | 1/2004 | Hay et al. | 312/405.1 |
| 2004/0237565 | A1 * | 12/2004 | Lee et al. | 62/344 |
| 2006/0168983 | A1 | 8/2006 | Tatsui | |
| 2006/0260325 | A1 | 11/2006 | Lin | |
| 2006/0260350 | A1 | 11/2006 | Van Meter | |

(Continued)

FOREIGN PATENT DOCUMENTS

| | | | |
|---|---|---|---|
| DE | 102010001465 | A1 | 8/2011 |
| DE | 102010042080 | A1 | 4/2012 |

(Continued)

OTHER PUBLICATIONS

EP Search Opinion, EP2738483, Dated Feb. 2, 2015.

(Continued)

*Primary Examiner* — Emmanuel Duke

(57) ABSTRACT

A refrigerator may include a refrigerator cabinet in at least one enclosure that can be mounted in different locations within the cabinet. The enclosure also can have targeted, independently controlled temperature provided to it. This allows the refrigerator to be highly customizable and reconfigurable according to desire or need. For example, an ice maker ice bin can be mounted in different positions within the cabinet, including door mount, refrigerated food compartment mount or freezer mount. Alternatively, specialized enclosures for such things as can chilling, milk chilling, meat chilling, or even thawing can be placed in multiple locations in the cabinet according to need or desire.

20 Claims, 9 Drawing Sheets

(56) References Cited

U.S. PATENT DOCUMENTS

| | | | | |
|---|---|---|---|---|
| 2007/0209382 | A1* | 9/2007 | Kim et al. | 62/340 |
| 2008/0141699 | A1* | 6/2008 | Rafalovich et al. | 62/340 |
| 2010/0126185 | A1 | 5/2010 | Cho | |
| 2011/0110706 | A1 | 5/2011 | Allard et al. | |
| 2012/0167596 | A1 | 7/2012 | Krause | |

FOREIGN PATENT DOCUMENTS

| | | | |
|---|---|---|---|
| EP | 1821051 | A1 | 8/2007 |
| EP | 2444761 | A2 | 4/2012 |

OTHER PUBLICATIONS

EP Search Opinion, EP2738484, Dated Feb. 23, 2015.
EP Search Opinion, EP2738485, Dated Feb. 2, 2015.
EP Search Opinion, EP2738496, Dated Feb. 2, 2015.
EP Search Opinion, EP2738497, Dated Feb. 2, 2015.
DE102010042080 Machine Translation from Espacenet.
DE102010001465 Machine Translation from Espacenet.
Vian, J. et. al, "Development of a Thermoelectric Ice Maker of Fingers Incorporated into a Static Domestic Refrigerator", 5th European Conference on Thermoelectrics, Sep. 10, 2007, pp. 1-6.

* cited by examiner

CUSTOM BIN INTERFACE

FIELD OF THE INVENTION

The present invention relates to refrigerators. More particular, the present invention relates to refrigerators with one or more moveable bins that can be placed in a variety of positions within the same refrigerator and which can be temperature-controlled independently of the refrigerator compartment(s) in which it/they are placed.

BACKGROUND OF THE INVENTION

One conventional refrigerator configuration uses a forced air/condenser arrangement to provide air cooling to at least one compartment of an insulated refrigerator cabinet. The cooling is for an entire compartment. In the case of multiple compartments, the paradigm is similar—the forced air/condenser cooling is controlled by conventional means to provide targeted temperature for the different compartments; but for each full compartment. Everything in the compartment would be subject to that basic controlled temperature.

There are significant benefits to having more specifically targeted temperature controlled areas within the larger compartment or overall cabinet of the refrigerator. For example, some differences in temperature for meats or cheeses may be desirable as opposed to the rest of a refrigerated food compartment. Another example could be the desire to make ice at subfreezing temperatures outside of the freezer compartment, if the refrigerator has one. This presents issues for conventional forced air/condenser cooling. Routing cooling air to multiple sub-areas inside a refrigerated compartment has functional and practical limitations for mass-market type refrigerators. Size, cost, and other factors bear on that issue.

Additionally, it can be desirable and beneficial to allow a refrigerator to be reconfigurable or convertible. By that, it is meant that a need has been identified in the art to allow custom temperature control for areas within the cabinet and to allow those custom controlled areas to be selected by the user or consumer. Again, routing cooling air to changeable locations presents practical issues, particularly in mass market refrigerator appliances.

SUMMARY OF THE INVENTION

Therefore it is a primary object, feature, or advantage of the present invention to improve over the state of the art.

It is a further object, feature, or advantage of the present invention to provide for a refrigerator appliance which allows for targeted but reconfigurable independently controlled temperature sub-spaces within any part of a refrigerator cabinet.

A still further object, feature, or advantage of the present invention is a system for allowing custom configuration of a refrigerator appliance.

Another object, feature, or advantage of the present invention is a system for providing a variety of selectable factors to reconfigure a refrigerator appliance, those factors include, but are not limited to, type of independently temperature controlled enclosure, position of independently temperature enclosure, manner of providing temperature control to each enclosure, and adjustability of each enclosure.

One or more of these and/or other objects, features, and advantages of the present invention will become apparent from the specification and claims that follow. No single embodiment need exhibit each and every object, feature, and advantage as different embodiments may have different objects, features, or advantages. The present invention is not to be limited by or to these objects, features, and advantages.

According to one aspect, a refrigerator is provided. The refrigerator may include a refrigerator cabinet and at least one compartment disposed within the refrigerator cabinet. The refrigerator may further include an enclosure defining an enclosed space that can be independently temperature controlled and placeable in a plurality of different locations within the refrigerator cabinet.

According to another aspect, a method of custom configurable refrigeration allows selectable type and placement of independently temperature controlled enclosures within the refrigerator cabinet.

According to another aspect, a refrigerator includes a refrigerator cabinet, an enclosure, a subsystem for providing independent temperature control to the enclosure, and quick-connections for facilitating independent temperature control for the enclosure at a plurality of positions within the refrigerator cabinet.

According to another aspect, a refrigerator includes a refrigerator cabinet, an enclosure defining a smaller enclosed volume than one of the compartments of the refrigerator cabinet, a subsystem to provide heating or cooling to the enclosed sub-space, a releasable connection for facilitating independent temperature control to the sub-space, a controlled subsystem for managing independent temperature control to the sub-space, and a mounting interface for the enclosure to a location in the compartment of the refrigerator cabinet.

BRIEF DESCRIPTION OF THE DRAWINGS

FIG. 1 also shows diagrammatically a few examples of different types of independent temperature control enclosures that can be utilized with the embodiment of FIG. 1.

DETAILED DESCRIPTION OF EXEMPLARY EMBODIMENTS

Overview

For a better understanding of the invention, several exemplary embodiments will now be described in detail. It is to be understood these embodiments are neither inclusive nor exclusive of all the different forms the invention can take, which are defined by the appended claims that follow this description.

These exemplary embodiments will be described primarily in the context of a mass-market commercially available refrigerator appliance of the top French-door accessible refrigerated food compartment and a bottom freezer compartment. Those compartments will both be temperature controlled by a forced air/condenser system which cools those compartments to the conventional temperature ranges for refrigerated food versus freezer compartments such as is known in the art. The forced air/condenser cooling system is not shown in the Figures for clarity of illustration of the exemplary embodiments. It is to be understood, however, that the invention can be applied to almost any refrigerated device of almost any configuration, including single compartment devices or more than two compartments, whether top freezer, side by side, or others.

As will be appreciated, one unifying feature of the embodiments is the ability to custom configure the appliance by selection of a type of enclosure that can be independently temperature controlled and then selectable placement of it in a variety of locations within the appliance.

Exemplary Embodiment 1

Liquid Cooled Bin

Figure 1:
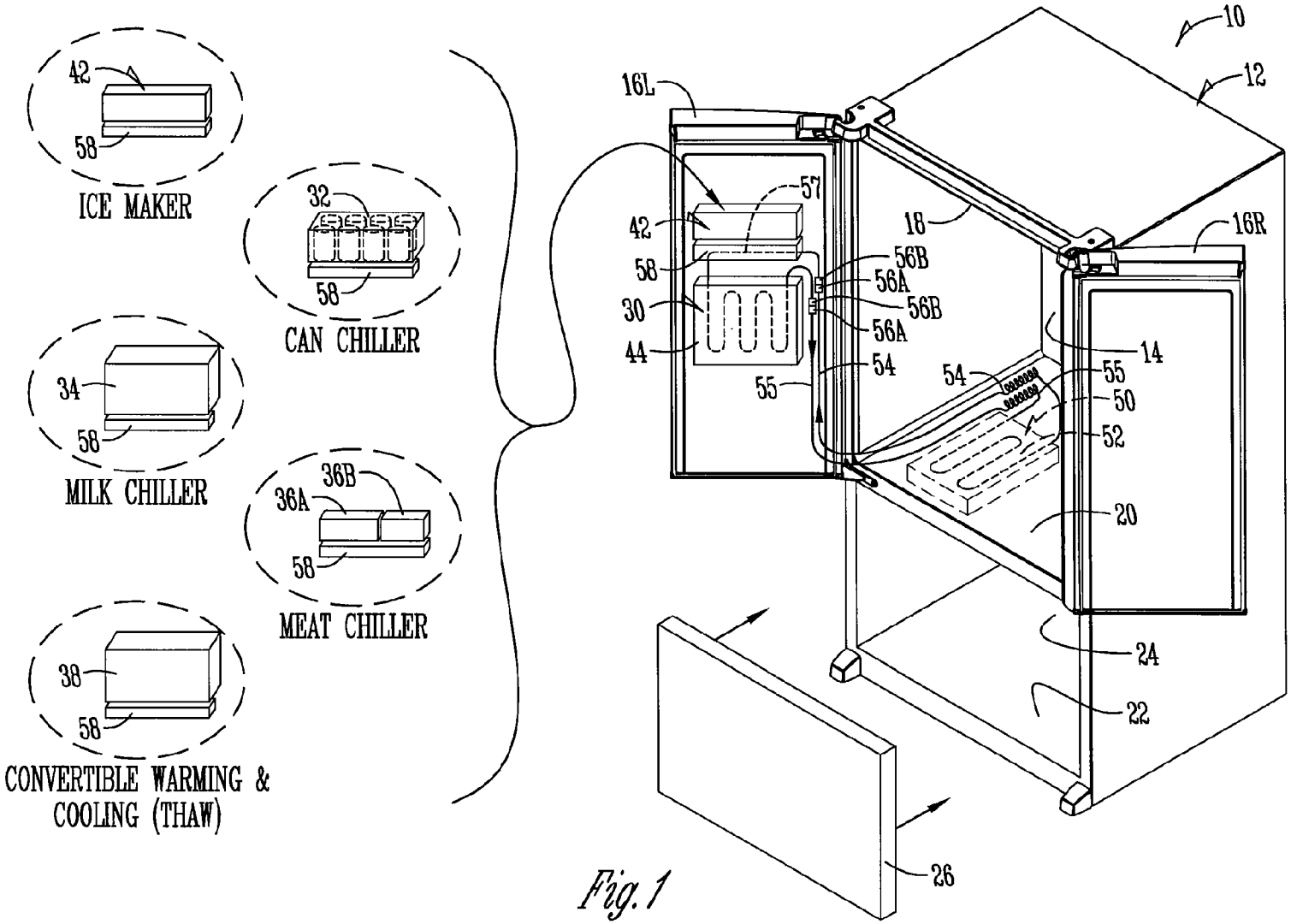
FIG. 1 illustrates diagrammatically a refrigerator cabinet with an upper refrigerated food section and a lower freezer section, with an exemplary embodiment of the present invention related to a liquid cooling subsystem for cooling a moveable closure mounted on a door to the refrigerated compartment according to an exemplary embodiment of the present invention.

FIG. 1 illustrates a refrigerator appliance 10 with an insulated cabinet 12 and top fresh food compartment 14 accessible by French doors 16L and 16R. A bottom freezer compartment 24 is accessible with a door 26. Refrigerator compartment 14 and freezer compartment 24 are separated vertically by ceiling 18, floor 22, and intermediary divider 20. A forced air/condenser electrically powered cooling system and programmable controlled electrical temperature sensor and control system (not shown) allow forced air cooling within controlled ranges in compartments 14 and 24. This is conventional and well known to those skilled in the art.

An enclosure 30 (sometimes called a bin) defining an enclosed volume is mounted on the inside of door 16L. In this embodiment, enclosure 30 is insulated and is in operative connection to a liquid cooling subsystem 50. Liquid cooling subsystem 50 includes a unit 52 positioned in the freezer compartment 24 (e.g. mounted on the underside of the divider 20 exposed to subfreezing air of freezer compartment 24) and can include a liquid reservoir and a fluid pump that is electrically controlled by the programmable controller. Fluid tubing sections 54 and 55 are routed from unit 52 to at or near enclosure 30 in door 16L to target and deliver fluid in a fluid loop 57 to container 30.

As diagrammatically illustrated in FIG. 1, liquid cooling unit 52 would have an outbound tube section 54 that would extend and be moveable to reach different locations within refrigerator cabinet. As illustrated, it could have a coiled section that would allow longitudinal adjustability to assist in extending it or moving it to different locations. Similarly, inbound or return tube section 55 could have such flexibility. At the distal ends of tube sections 54 and 55 could be quick connect fluid connectors 56A that would mate with complimentary quick connect connectors 56B at opposite ends of fluid tubing loop 57. Loop 57 could be mounted on, in or near either the structure to be temperature controlled (cooled or warmed). In FIG. 1, it is shown mounted on or in an interface or plate 58 that could be separate or attached to the enclosure or bin to be temperature controlled. As illustrated, a complete fluid circuit from at temperature control unit 52 placed away from the bin to be temperature controlled would circulate fluid through tube section 54, through its connectors pair 56A and B, into loop 57, back through connector pair 56A and B to return tubing section 55. By methods known in the art, temperature of the fluid in that circuit could be controlled by unit 52 to supply cooling or heating at fluid loop 57, which is at the bin to be temperature controlled. As can be appreciated, fluid loop 57 could take on many configurations. It could be at or near just ice bin 44. Alternatively, it could be at just ice maker 42 to provide subfreezing temperatures to the ice mold for making ice. Or, as shown in FIG. 1, it could be routed at or near both ice maker 42 and ice bin 44. It could supply subfreezing temperatures to ice bin 44 to maintain solid phase of ice stored in bin 44. It could supply such cooling to both ice maker 42 and ice storage bin 44. As could be further appreciated, ice maker 42 and ice bin 44 could be separated. A loop 57 could be routed to one or the other or both. Thus, very cold fluid can be pumped to at container 30 to provide cooling to container 30. By methods known to those in the art, by control of flow rate, selection of fluid, and other parameters, the amount of cooling to bin 30 can be independently controlled of the temperature of freezer compartment 24 or refrigeration compartment 14.

In this embodiment, tubing 54, 55 can have a quick connections 56A which can quick connect or release from complementary connections 56B of loop 57 at enclosure 30. For example, quick connect devices or connectors 56B at enclosure 30 can receive quick connect connections 56A at the distal end of each tube 54 and 55 and by wedging action provide a robust and secure and sealed attachment of the tube at one end of the tubing of loop 57. But the connectors 56A and B can be easily reversed from connection to allow quick disconnection of the tubing at that point. A variety of these connectors are commercially available. One example is Product No. PL-3003 from Watts of North Andover, Mass. for a ¼" outside diameter plastic tube. As can be appreciated, such connectors 56A and B would allow a user to mount the temperature control moveable bin at a selected position and then with just two quick connections connect the liquid cooling lines 54 and 55 to the loop 57 to complete the liquid flow circuit for independent temperature control of the bin.

The cooling fluid to enclosure 30 can be delivered in a number of ways to effectuate cooling of enclosure 30. One would be simply to snake loop 57 or a portion of additional tubing along a surface of enclosure 30. Cooling can occur by conduction between the walls of enclosure 30 to the fluid in tubing sub-circuit on the exterior of enclosure 30. The tubing could be built into the wall of enclosure 30. Still further, that extended tubing sub-circuit could be built into a plate or panel that is put into abutment with an exterior wall of enclosure 30 for conduction of heat away from the interior of enclosure 30. Alternatively, such a plate could be put in close proximity to the exterior of enclosure 30 and take heat away by convection.

The specific ways and modes of providing cooling to enclosure 30 with the liquid subsystem 50 can be in any of a number of configurations within the skill of those skilled in the art. Tubing 54, 55 and 57 can deliver cooled fluid to at or near enclosure 30 and that fluid can remove heat back to unit 52 where the heat carried in that fluid can then be removed or redirected and cooled fluid recirculated when needed.

Again, operation of unit 52 can be controlled by a refrigerator or other microcontroller based on programmed and/or sensed parameters. Some sort of user-adjustable input is possible that would allow the user of refrigerator 10 to select a target temperature range or value for the interior of enclosure 30. This could be via some sort of simple knob with indicia giving a range of temperatures or by some sort of user interface that could instruct the controller. Other modes and methods for user-selection of temperature for bin 32 are of course possible.

FIG. 1 illustrates the possibility that enclosure 30 could be an ice bin or ice storage container underneath an indoor ice maker 42. In this example, the specific type of enclosure 30 (here, ice bin 44) could thus have subfreezing temperatures to maintain ice storage even though it is positioned in a door that is opened to ambient temperature and when the door is closed in the refrigerated food compartment (above freezing). The liquid cooling subsystem takes advantage of the subfreezing temperatures in freezer compartment 24 to bring the ice bin 44 to lower temperatures than refrigerator compartment 14 for maintenance of ice storage. Again, the ice maker and the ice bin could instead be separated. They could be separated a substantial distance and subfreezing temperatures routed to each.

But as further indicated in FIG. 1, the liquid cooling subsystem 50 could likewise service ice maker 42. Again, by tubing 54, 55 and releasable connections 56A/B to loop 57, cooling liquid could be routed to ice maker 42 (e.g. ice mold within ice maker 42) that provides subfreezing temperatures for freezing ice in ice maker 42. But furthermore, as illustrated by the examples on the left side of FIG. 1, enclosure 30 could be any of a number of other types of enclosures. For example, it could be configured as a can chiller 32, and temperature controlled to some specific above-freezing temperature maintenance the consumer desires for canned beverages. Another example would be milk chiller 34. A still further example could be meat chiller 36. Meat chiller 36 could have multiple compartments.

In all of these examples, the enclosure body 30 could have some sort of access to its interior. This could be a door, a flap, some sort of opening of relatively small area, or otherwise such that reasonable independent control of temperature inside enclosure 30 is possible including on an economical and efficient basis. For example, ice bin 44 may receive ice dropped by gravity from ice maker 42. It would likely need an open top to receive such ice. But it also could have a door or other opening for someone to reach in to extract ice. Still further, ice bin 44 could have releasable mounting interface with the inside of door 16L so that it could be taken off of door 16L.

Similarly, ice chiller 34 would have to have a substantial sized door or method of inserting and removing milk. This could range from smaller containers (e.g. pint sized) to perhaps even larger ones (e.g. one gallon jugs).

Meat chiller 36 could have multiple doors or openings and multiple compartments. It is even possible that in one enclosure 30, there could be ways to have different temperatures in compartments 36A and 36B (e.g., perhaps a relatively small offset targeted for one type of meat versus another).

As can be understood, liquid cooling subsystem 50 provides the ability to, in a targeted, independent manner, provide cooling to an enclosure 30 that can be of a variety of types.

FIG. 1 diagrammatically illustrates a still further potential feature. An enclosure 38 could be convertible between warming and cooling. By methods and modes known in the art, liquid cooling subsystem 50 could be configured to either provide subfreezing temperature to enclosure 38 or merely cooling (above freezing) temperature. Such above-freezing temperature could be controlled and arranged that could facilitate fast thawing of frozen food. It also could be configured simply as a higher temperature, yet cooled from outside ambient temperature for any number of uses. As can be appreciated, unit 52 could include a thermo-electric cooler device (TEC). Because a TEC produces a temperature differential between opposite sides of its thermo-electric element, using a TEC in the unit 52 would allow selection of either colder temperatures for the liquid to be circulated or hotter temperatures. Thus, this would allow the designer to route different temperatures to the moveable bin. As can be appreciated, by appropriate tubing sections and fluid switching components, the refrigerator could select or switch between cooler or warmer liquid for routing to the moveable bin. Other ways of generating warming that could be routed to moveable bin 30 are possible.

A still further feature could be adaptation and operation of liquid subsystem 50 to provide what might consider to be warming to enclosure 38. By methods and modes known to those skilled in the art, control of liquid flow could be such that interior temperature of container 38 would be able that in even refrigerated compartment 14.

It can therefore be seen how the system of FIG. 1 allows substantial flexibility and customizability of a refrigerator appliance.

Figure 2A:
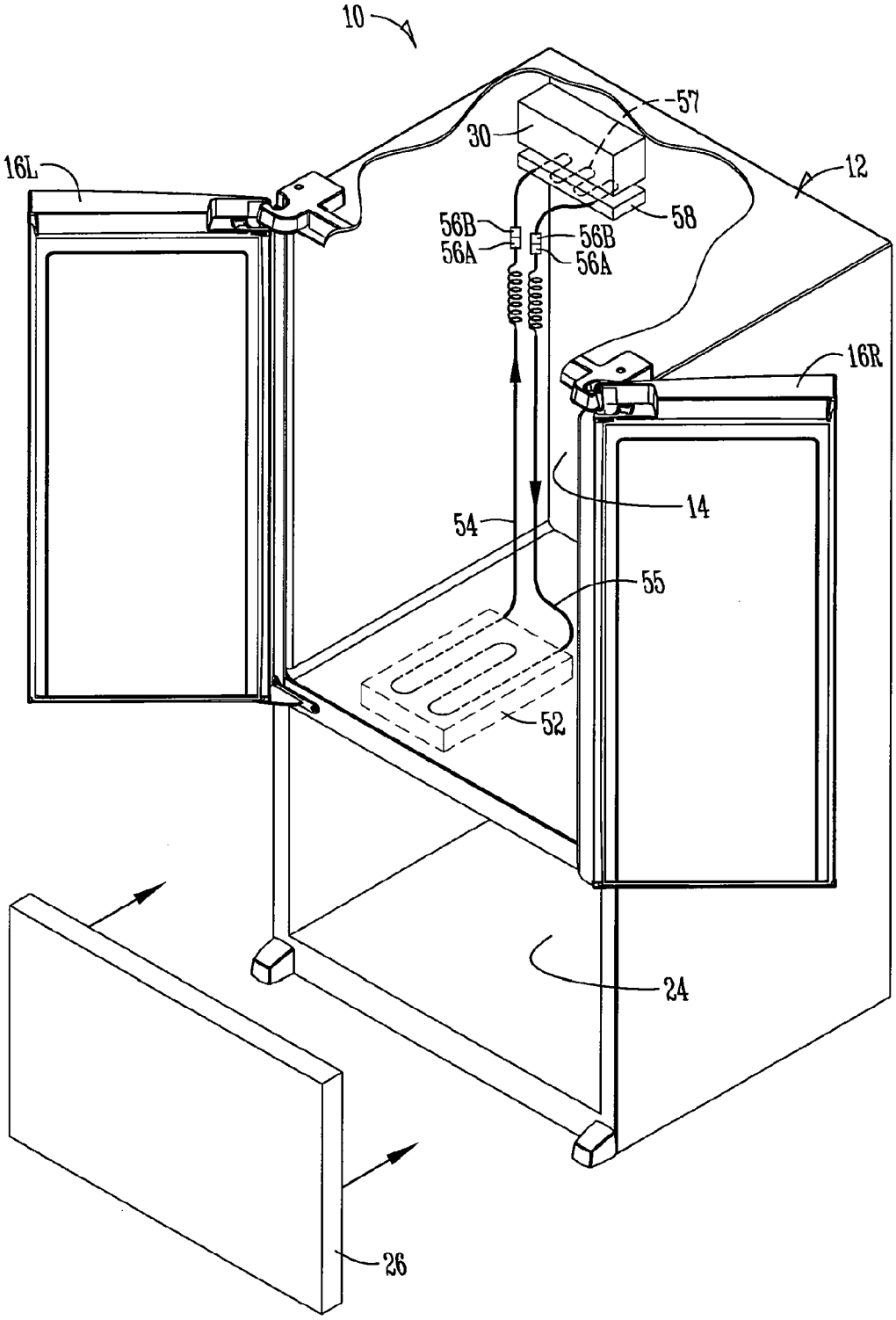
FIGS. 2A-E illustrate a few examples of different placement locations within the refrigerator cabinet for an independently temperature controlled enclosure of the type of FIG. 1.
Figure 2B:
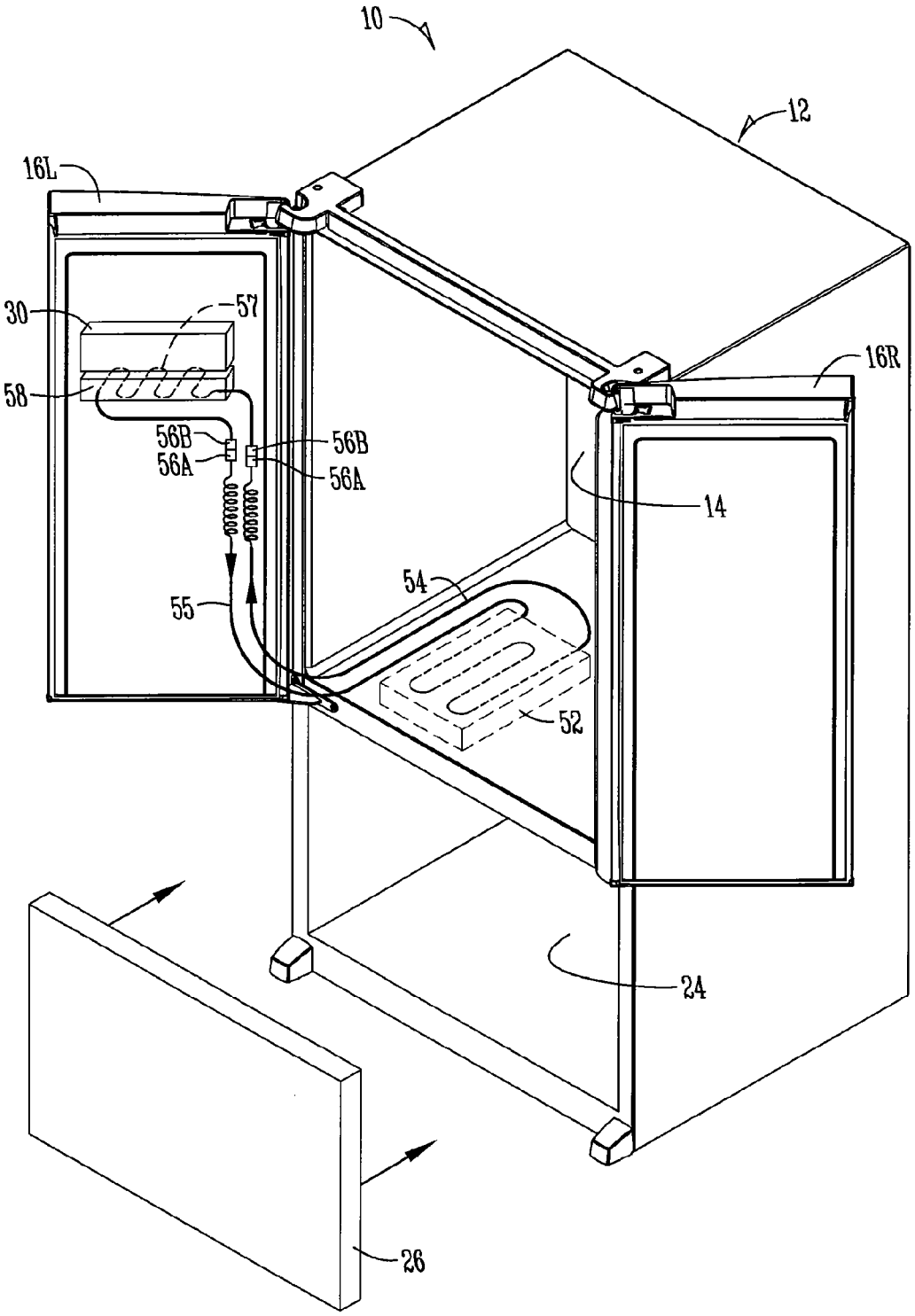
Figure 2C:
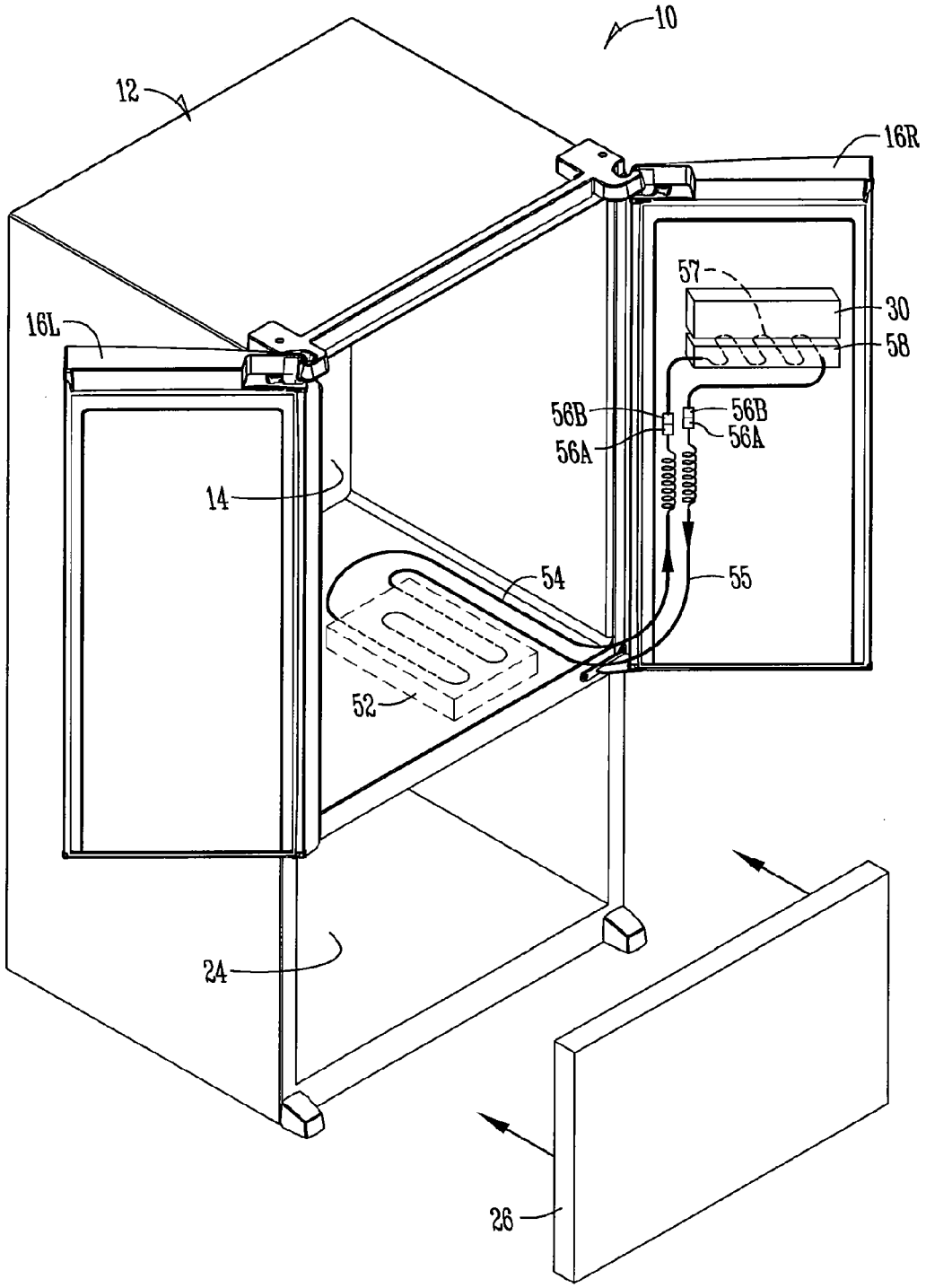

FIGS. 2A-E illustrate another aspect of this flexible, reconfigurable customizability. As illustrated diagrammatically in FIGS. 2A-E, whichever type of enclosure 30 is selected could be mounted in any number of different positions within refrigerator cabinet 12. FIG. 1 shows ice bin 44 on refrigeration compartment 14 door 16L. FIG. 2A shows any of the types of enclosures 30 mounted inside refrigeration compartment 14; here in the upper back corner (either mounted to ceiling 18 or to the upper back wall or to the left side wall). FIG. 2B illustrates a generic independently temperature controlled enclosure 30 on the inside of refrigerated compartment 14 door 16L. FIG. 2C shows it on the opposite door. In any of these cases, liquid cooled subsystem 50 is mounted in the freezer compartment 24 and via fluid communication of tubing 54 can route cooling fluid in a loop to the enclosure 30 in any of those positions. Again, quick release tubing connectors at enclosure 30 could allow same liquid cooling unit 52 and tubing 54, 55 to be routed to any of these mounting locations.

Figure 2D:
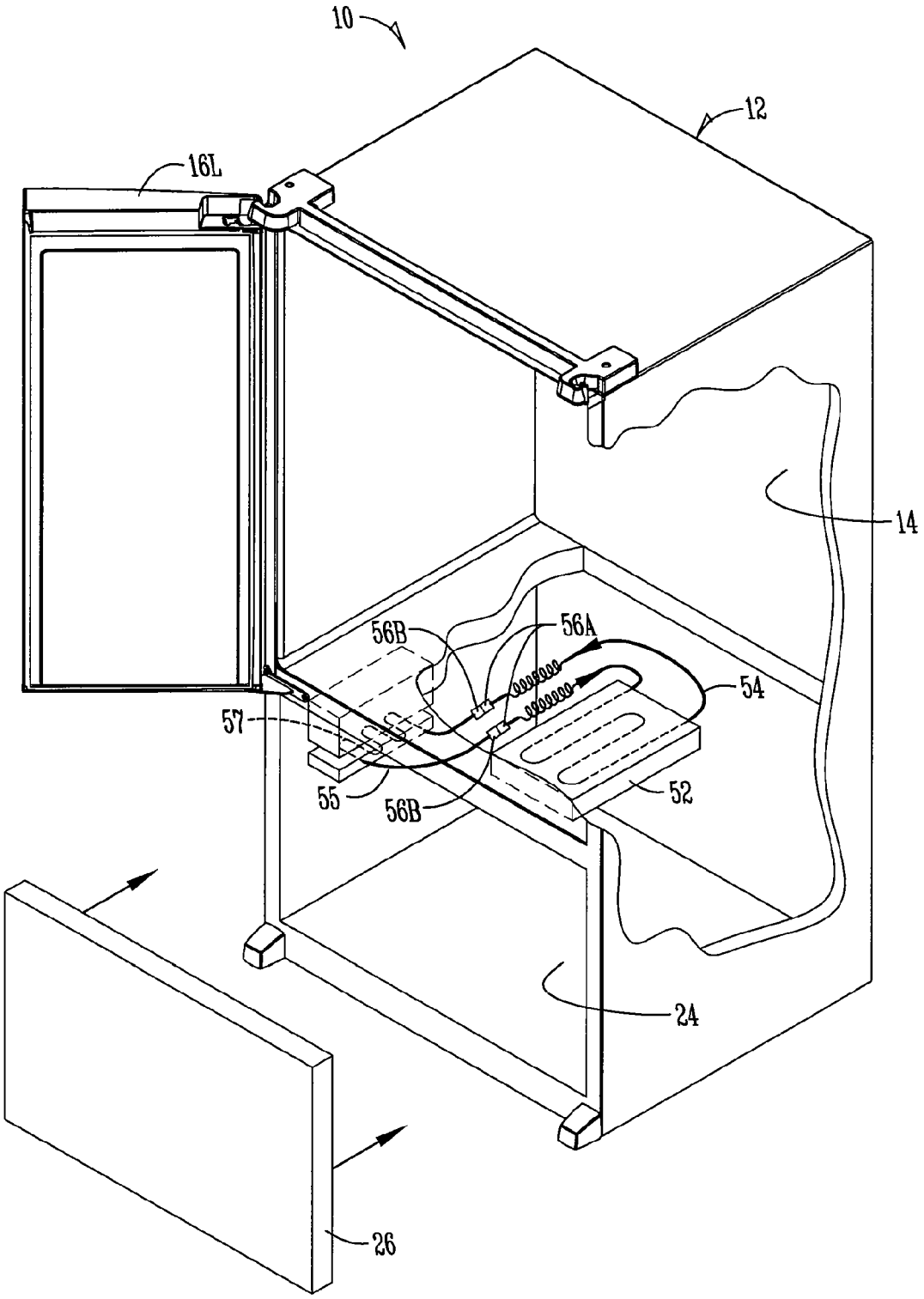

FIG. 2D illustrates that an enclosure 30 could be placed at or near liquid cooling unit 52 in the freezer compartment. Tubing 54, 55 could be used to route fluid (out-bound and return paths respectively, to unit 52) to that container 30. As can be appreciated, the fluid could be a substance such a glycol, which would not freeze. Such an enclosure in the freezer compartment could be used simply as a subspace for frozen food with independent temperature control, or could be used for thawing or other uses.

Figure 2E:
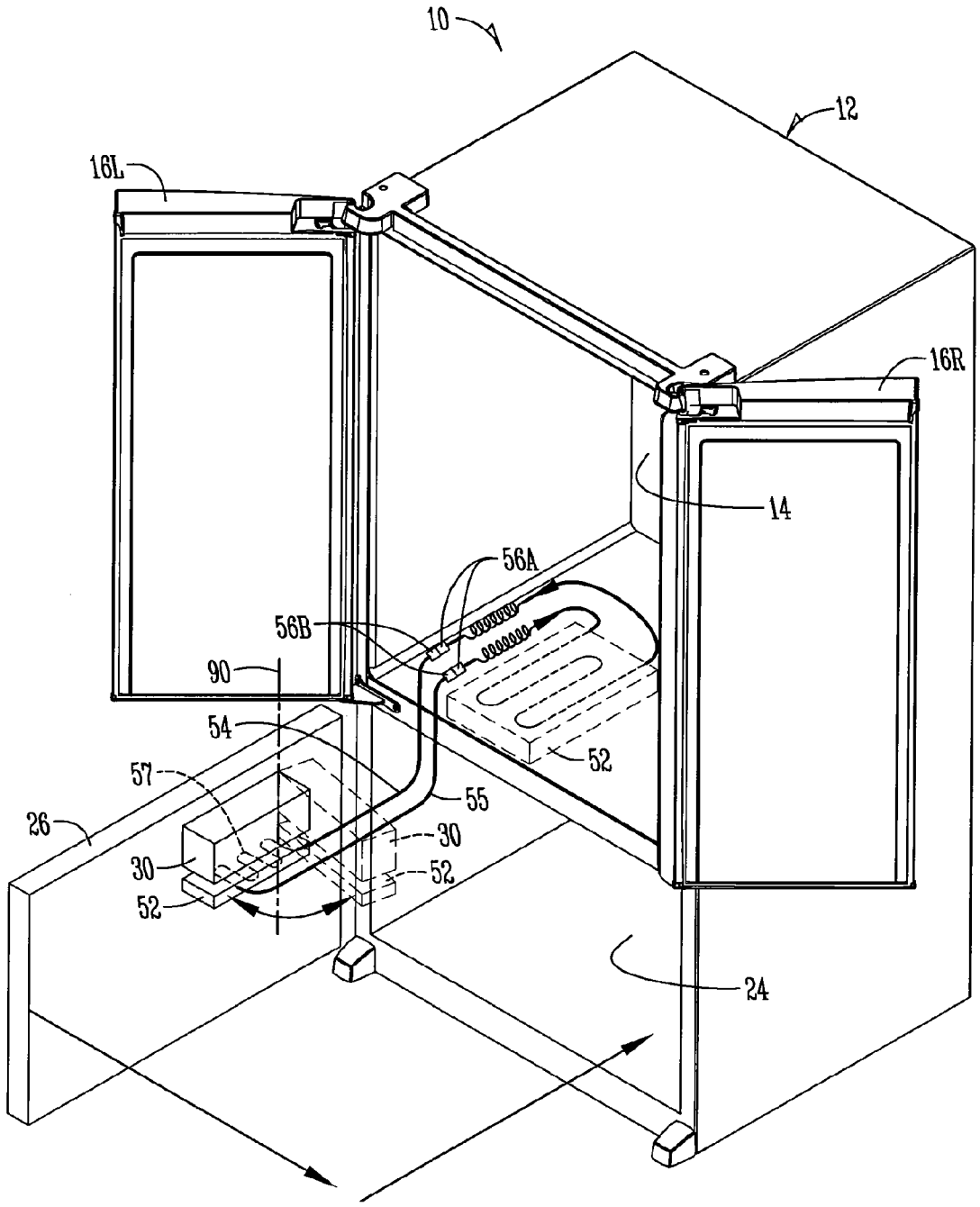

FIG. 2E shows a slightly different configuration where the enclosure is mounted on the inside of the freezer compartment door 26. In this example, the enclosure could be an ice bin 44 and/or an ice maker 42. Even though such devices would be in the freezer compartment, it would allow for independent targeted control of temperature for those functions. Alternatively, it could facilitate temperature control that might require both subfreezing temperatures and above-freezing temperatures even though in the freezer compartment. For example, in some cases it is desirable to remove ice from an ice mold by raising its temperature so it drops out of the ice mold, rather than requiring some rotation or twisting of the ice mold. In another example, it can be beneficial to independently control temperature at the ice mold in a more specific and precise way than the freezer compartment as a whole. One example is in making what is called clear ice.

Figure 3A:
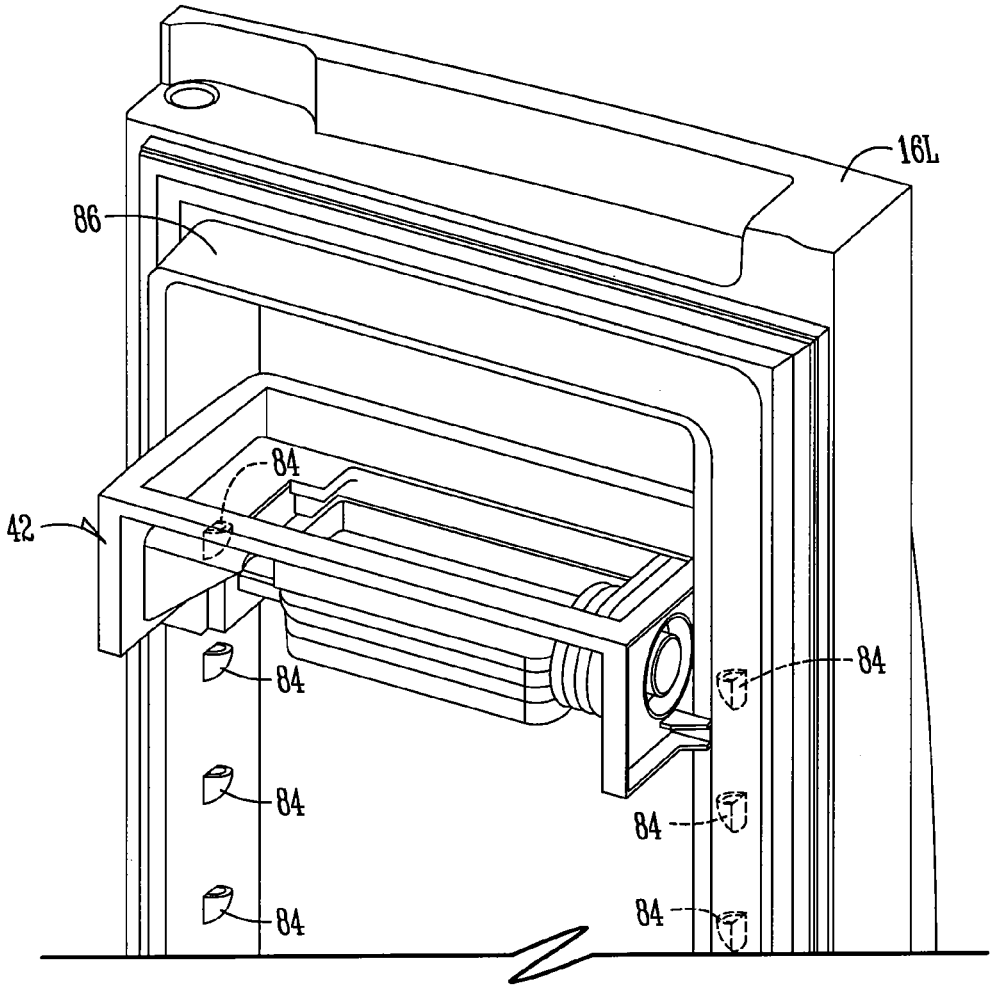
FIGS. 3A-C illustrate diagrammatically different ways in which a moveable independently temperature controlled enclosure or device can be adjustably mounted within a refrigerator cabinet and have quick connect or releasable connections for either electrical power or liquid conduits.
Figure 3B:
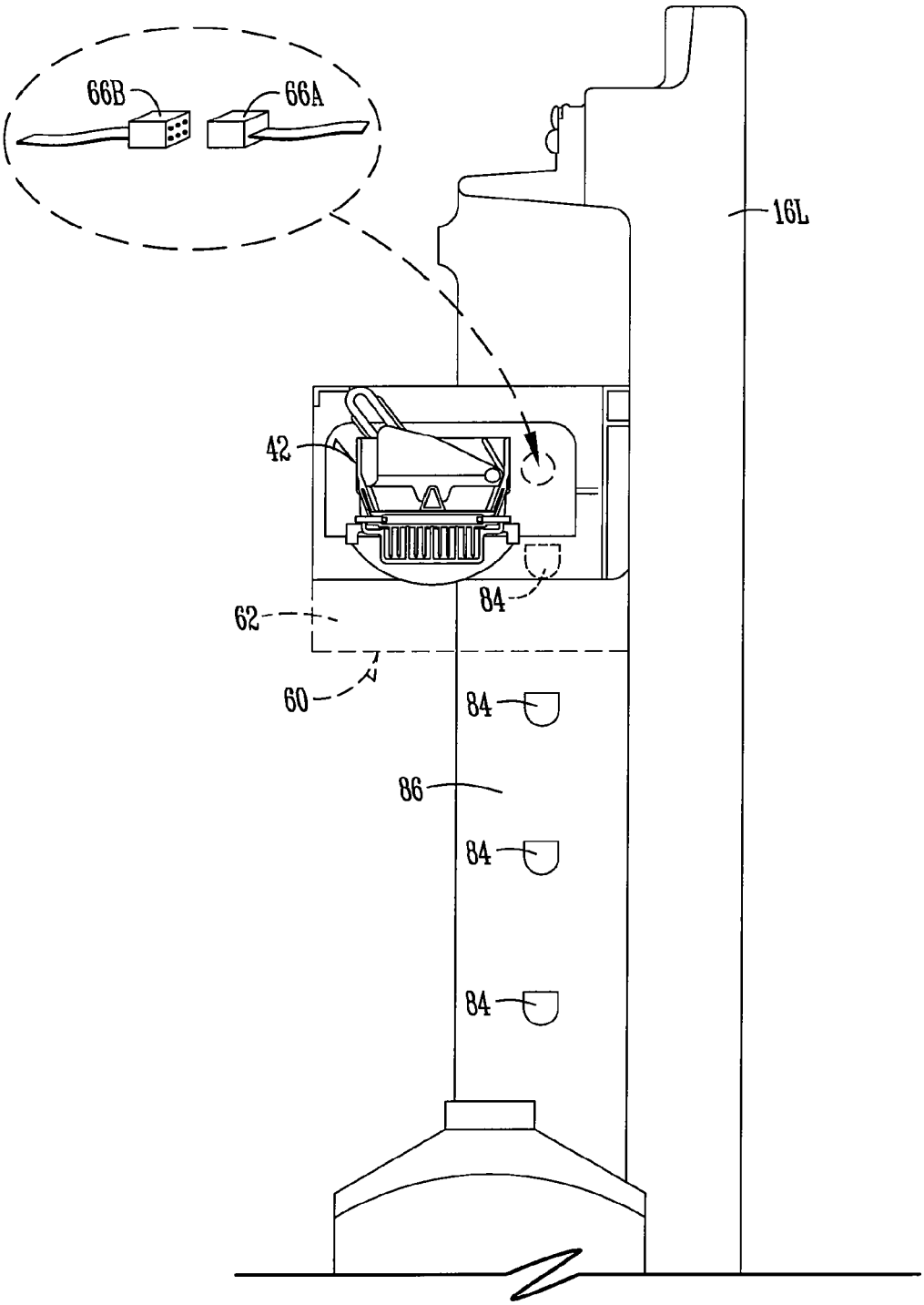
Figure 3C:
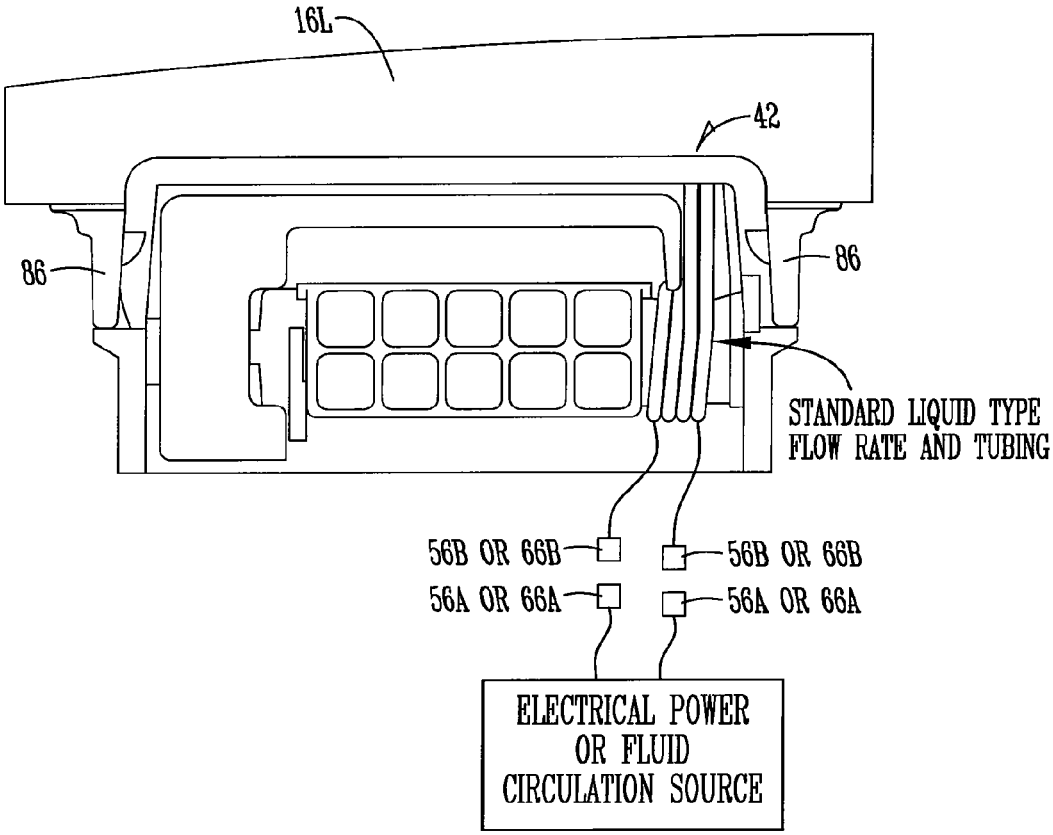

FIGS. 3A-C illustrate one exemplary configuration for adjustable mounting of the enclosure 30 to be temperature-controlled. As can be seen in FIG. 3A in the context of ice maker 42, the inside of door 16L could include on opposite sides of door liner 86 molded receivers 84 at spaced apart vertical heights. Complementary pins or ears (not shown) on opposite sides of ice maker 42 would drop in vertically into a set of receivers 84 on opposite sides of liner 86 at a certain vertical height. The pair of receivers 84 would capture the pins and prevent movement of ice maker 42 in any direction except back vertically up. By this method, ice maker 42 could be quickly mounted at any of the vertical heights of horizontal sets of receivers 84.

Such pin and receiver mounting configurations are well known in the art. See, e.g., US 2011/0110706 A1 to Whirlpool Corporation, incorporated by reference herein. Other releasable mounting interfaces are possible of course. Examples could include sets of vertical rails with openings to receive hooks (like glass shelving in refrigerators), or pins extending from the wall of the cabinet on which receivers on the enclosure 30 are hung. There are many known and analogous ways to releasably mount an item in a refrigerator cabinet.

FIGS. 3A-C also illustrate that releasable connectors for fluid flow and/or electricity can be utilized to further allow quick and easy connection of an enclosure 30 in whatever form (including electrically activated components such as ice maker 42 and the like). For liquid flow connectors, they have been discussed previously. For electric connectors, examples are Molex connector pairs 66A and B (FIG. 3B) or analogous electrical connectors.

As can be further appreciated, there could be just one mounting connection for each different location within refrigerator cabinet 12. In other words, it is not required that there be vertical adjustability at each mounting location.

Therefore, this embodiment addresses one or more of the objectives of the invention. It allows custom configuration of a refrigerator. It allows custom temperature needs at a place within a refrigerator. It allows custom temperature needs at any place within a refrigerator without having to route air. It furthermore allows any of a variety of different types of enclosures or bins to meet the temperature ranges and locations throughout the refrigerator. It can facilitate this by standard interfaces at each location and for each type of bin.

For example, as indicated in FIG. 1, although having different functions and some differences in configuration, each of the different enclosures 44, 42, 32, 34, 36, and 38 could have the same geometry of mounting pins or ears that would cooperate with a coordinated pair of receivers 84 so that any of those enclosures could be mounted on receivers 84. And such sets of receivers 84 could be repeated at the various locations for mounting, as shown in FIGS. 2A-E; or in other locations.

And, as mentioned, by temperature sensors or other modes and manners known in the art, the refrigerator controller can monitor for a selectable temperature for an enclosure 30 and operate the liquid cooling subsystem 50 accordingly to deliver the instructed temperature to that targeted subspace in that enclosure 30.

Exemplary Embodiment 2

TEC Cooled Moveable Bin

Instead of some sort of plate 58 that includes a fluid pathway from tubing 54, 55 of liquid cooled subsystem 50, a thermal electric cooler (TEC) such as are well known in the art, could be used as the temperature control subsystem for an enclosure 30.

TECs can be configured in a planar or plate-like configuration. They are a solid state electrically powered device that can create a temperature difference between opposite sides; one cooler, one warmer. Thus, electrical operation of a TEC can provide cooling temperatures (including subfreezing) on one side. Warmer temperatures (can be quite warm or hot) can be on the other side. This device, therefore, can be a source of cooling or heating.

Therefore, this second embodiment substitutes a TEC subsystem 60 for the liquid cooling subsystem 50 of the figures. Its form factor can be such as a plate-like device that can be mounted in abutment or very near a surface of an enclosure 30. By merely supplying sufficient electrical power, depending on what side is in abutment with enclosure 30, either cooling or warmer temperature can be provided by conduction or convection to enclosure 30 to control its interior temperature. Furthermore, the form factor of TECs is such that they do not occupy much physical space, but provide a substantial surface area for heat transfer.

Thus, as can be understood, substitution of a TEC unit 62 for liquid cool temperature interface 58 in the figures, and then simply with an electrical communication with electrical conduits (see, i.e., FIG. 3B) can deliver targeted temperature control to the subspace of an enclosure 38. The refrigerator controller via methods and modes known in the art and discussed herein can provide operation of a TEC to maintain a set or selectable temperature target for enclosure 30. As indicated in FIG. 3B, quick release electrical connectors, such as Molex connectors, could be used to allow the TEC to be moved to other locations in the cabinet 12. Alternatively, a TEC/enclosure combination could be integrated and moved to various locations in cabinet 12. Quick release mounting like shown in FIGS. 3A-C or otherwise, can be utilized for further convenience.

Exemplary Embodiment 3

TEC and Liquid Cooled Moveable Bin

Still further, a combination of liquid cooling loop and TEC could be used to provide a custom reconfigurable independent temperature control of moveable containers or enclosures 30. A TEC/liquid cool subsystem (not shown) could operate a TEC with electrical energy at a first location in cabinet 12. A liquid cooling loop with pump unit 52 could be placed in proximity to the TEC and take advantage of the TEC to either cool or warm the fluid. Tubing 54, 55 can then route that fluid to targeted areas within cabinet 12. An advantage of this arrangement is that the TEC could be placed anywhere in cabinet 12. Compare unit 50 in FIG. 1 which is positioned in subfreezing freezer compartment 24 if needed for subfreezing temperature control.

As can be understood, because the TEC has a warm side, it can be utilized for warming. Thus, configurations are possible whereby either cooling or warming can be utilized from the TEC to the enclosure 30.

Options & Alternatives

The foregoing exemplary embodiments are by example only and not by limitation. Variations obvious to those skilled in the art are included within the invention, which is described by the claims that follow.

For example, the enclosure type, size and configuration can vary according to need or desire. Likewise, the number of locations in a moveable enclosure that can be mounted can vary. Furthermore, the types of components can be balanced to provide cooling or warmer versus what is needed or desired for temperature control in the specific enclosure. Consumption of electrical energy and heat management can be some of those factors.

Still further, the exact method of quick attach and detach of temperature control can vary. In one optional embodiment, quick release fluid connectors can be fixed and built into enclosure 30. Similarly, tubing 54, 55 might be routed inside the walls of cabinet 12 to exposed distal end openings at a surface of cabinet 12. As one example, fixed male connectors of enclosure 30 could then be "plugged in" to complementing female connectors at fixed distal ends of tubing 54, 55 in a wall of cabinet 12 instead of having exposed tubing. In a still further optional embodiment, the mounting structure for enclosure 30 to a wall of cabinet 12 could be at or around that fluid connection quick release combination. In a similar fashion, electrical connections could be built in to enclosure 30 and in a surface of cabinet 12. Or at least, liquid connectors could be built in to one of the enclosure 30 or a wall of cabinet 12 with free distal ends of tubing 54 or freely manipulateable electrical cable that could be plugged in to fixed connectors.

Still further, if a bin 30 can be placed in multiple locations within cabinet 12, by some sort of mode or manner, the refrigerator controller can recognize where the bin is located. For example, if there are built in electrical connections at four different locations within cabinet 12, by monitoring voltage, resistance, or current at those built in connections, the controller can determine which connectors to supply electrical power to. Still further, if there are multiple mountable locations for delivery of fluid to built-in fluid lines, the controller could by some proximity sensing know the location and control a fluid valve to only allow fluid to that fluid branch.

A further option or feature could be secondary adjustment of the moveable bin. One example is diagrammatically illustrated in FIG. 2E. Moveable bin 30, mounted on the inside of the freezer compartment door 26, could be removably mounted at that position by a hinge connector along hinge axis 90. Not only could moveable bin 30 be placed in a selected position within the refrigerator, it could be hingeably connected (by releasable snap-in hinge between complimentary components on container or bin 30 and door 26). This feature could allow several things. It could allow a first anchoring of one end of bin 30 to door 26 and then swinging the other end of bin 30 into abutment with door 26 where one set of fluid or electrical quick connections 56 or 66 could be built into the door 26. This would allow easy quick snap-in connection of either liquid circuit or electrical power to adjust independently temperature of bin 30. By reverse swing-out movement (shown in dashed lines in FIG. 2E) the connection to the fluid or electrical circuit for independent temperature control could be disconnected quickly. The other end of bin 30 at hinge 90 could then be quick-released. Bin 30 could be removed and/or moved to another location which could contain a hinge mount with built-in fluid or electrical connectors, or some other quick mount configuration.

Still further, other secondary adjustment mounting of bin 30 could be utilized. Structure on bin 30 could slide into a receiver at a location in refrigerator cabinet 12 to roughly position bin 30. Further sliding could guide built-in liquid and/or electrical connections between bin 30 and the temperature control assembly or system.

Still further, for embodiments that utilize extendible or moveable fluid tubing or electrical wires to extend them to a selected mounting location for bin 30, those elongated connections could be free within cabinet 20 or could be routed partially or almost fully through walls or structure in a cabinet 12. For example, they could be routed through door hinges such as between door 16L or 16R and the interior of cabinet 12. They could be routed through a hinge such as hinge 90 of FIG. 2E. They could also be routed through walls or through shelves and the like.

What is claimed is:

1. A refrigerator, comprising: a refrigerator cabinet including at least one door: a fresh food compartment disposed within the refrigerator cabinet: a freezer compartment disposed within the refrigerator cabinet; a movable bin or enclosure and a heat transfer component including at least one conduit comprising a fluid carrying tubing section or an electric wire, the movable bin or enclosure including: a subspace with an access opening in proximity to the heat transfer component for temperature control of the subspace; a mounting interface having at least one quick attach and detach mounting member; at least one quick release connection to the conduit; a plurality of complementary mounts at different locations in the refrigerator cabinet for mounting the bin or enclosure in any of the plurality of different locations, the mounts each being complementary and standardized for the mounting interface of the moveable bin or enclosure; complementary quick release conduit connectors releasably connected to the conduit so that the heat transfer component of the moveable bin or enclosure can be quickly and easily connected or disconnected to a source of independent temperature control regardless of mounted location in the cabinet.

2. The refrigerator of claim 1 wherein the heat transfer component comprises a cooling loop for providing liquid cooling and the source of independent temperature control comprises tubing for conveying liquid to the moveable bin.

3. The refrigerator of claim 2 wherein the heat transfer component further comprises a thermo electric cooler (TEC) and wherein the source of independent temperature control further comprises electrical connectors for providing electrical energy to the TEC.

4. The refrigerator of claim 1 wherein the heat transfer component comprises a thermo electric cooler (TEC) and wherein the source of independent temperature control comprises electrical connectors for providing electrical energy to a TEC.

5. The refrigerator of claim 4 wherein the TEC provides one of cooling or warming to the subspace.

6. The refrigerator of claim 1 wherein the plurality of complementary mounts comprise receivers on one of the moveable bin or enclosure and cabinet and pins on the other of the moveable bin or enclosure and cabinet.

7. The refrigerator of claim 1 wherein at least one of the plurality of locations is on the at least one door.

8. The refrigerator of claim 1 wherein the at least one door comprises a door to the fresh food compartment.

9. The refrigerator of claim 1 wherein the plurality of locations are within the fresh food compartment.

10. The refrigerator of claim 1 wherein the cabinet comprises a bottom freezer compartment.

11. The refrigerator of claim 1; wherein the moveable bin or enclosure comprises an ice maker.

12. The refrigerator of claim 1; wherein the moveable bin or enclosure comprises a can chiller.

13. The refrigerator of claim 1; wherein the moveable bin or enclosure comprises a milk chiller.

14. The refrigerator of claim 1; wherein the moveable bin or enclosure comprises a meat chiller.

15. The refrigerator of claim 1; wherein the moveable bin or enclosure is a convertible bin.

16. A method comprising:

providing a refrigerator comprising (a) a refrigerator cabinet with at least one door, (b) a fresh food compartment disposed within the refrigerator cabinet, (c) a freezer compartment disposed within the refrigerator cabinet, (e) a moveable bin or enclosure and heat exchange component including a quick release mounting interface and a quick release conduit connector, (f) a plurality of complementary mounts in the refrigerator cabinet for mounting the moveable bin or enclosure and heat exchange component in any of a plurality of different locations, and (g) a complementary conduit connector for connecting the quick release conduit connector of the movable bin or enclosure and heat exchange component to a source, such that the moveable bin or enclosure can be independently temperature controlled;

customizing the refrigerator by selecting and operatively mounting the moveable bin or enclosure and heat exchange component to a selected location in the cabinet.

17. A moveable container for use within a refrigerator, the moveable container comprising:

a body defining a subspace;

one or more mounting connectors on the body for selectively mounting the moveable body to any of a plurality of different locations within the refrigerator;

a temperature control assembly operatively connected to the body, comprising a conduit, and adapted to control temperature associated with the subspace of the body; and a conduit connector operatively associated with the body for quick release connecting and disconnecting source conduit of one of a liquid circulation source and an electrical power source to the conduit of the temperature control assembly.

18. The moveable container of claim 17 wherein the temperature control assembly provides for liquid cooling or heating and wherein the conduit connector provides for releasable connecting a liquid cooling subsystem to the temperature control assembly.

19. The moveable container of claim 17 wherein the temperature control assembly comprises a thermo electric cooler (TEC) and wherein the conduit connector provides for connecting an electric power source to the TEC.

20. The moveable container of claim 17 wherein the mounting connectors comprise one of pins or pin receivers.

* * * * *